US009788588B2

(12) United States Patent
Allen et al.

(10) Patent No.: US 9,788,588 B2
(45) Date of Patent: Oct. 17, 2017

(54) HELMET AIRBAG SYSTEM

(71) Applicant: Elwha LLC, Bellevue, WA (US)

(72) Inventors: Paul G. Allen, Mercer Island, WA (US); Philip V. Bayly, St. Louis, MO (US); David L. Brody, St. Louis, MO (US); Jesse R. Cheatham, III, Seattle, WA (US); Richard G. Ellenbogen, Seattle, WA (US); Roderick A. Hyde, Redmond, WA (US); Muriel Y. Ishikawa, Livermore, CA (US); Jordin T. Kare, San Jose, CA (US); Eric C. Leuthardt, St. Louis, MO (US); Nathan P. Myhrvold, Medina, WA (US); Tony S. Pan, Bellevue, WA (US); Robert C. Petroski, Seattle, WA (US); Raul Radovitzky, Bedford, MA (US); Anthony V. Smith, Seattle, WA (US); Elizabeth A. Sweeney, Seattle, WA (US); Clarence T. Tegreene, Mercer Island, WA (US); Nicholas W. Touran, Seattle, WA (US); Lowell L. Wood, Jr., Bellevue, WA (US); Victoria Y. H. Wood, Livermore, CA (US)

(73) Assignee: Elwha LLC, Bellevue, WA (US)

( * ) Notice: Subject to any disclaimer, the term of this patent is extended or adjusted under 35 U.S.C. 154(b) by 0 days.

(21) Appl. No.: 14/663,315

(22) Filed: Mar. 19, 2015

(65) Prior Publication Data

US 2016/0270472 A1 Sep. 22, 2016

(51) Int. Cl.
*A42B 3/04* (2006.01)

(52) U.S. Cl.
CPC ..... *A42B 3/0486* (2013.01)

(58) Field of Classification Search
CPC ..... A42B 3/046; A42B 3/0486; A42B 3/122; A42B 3/0433; A42B 3/06; A42B 3/286; A41D 13/018; A63B 71/10; B60R 2021/01218; B60R 2021/165; B60R 2021/01238; B60R 21/20; B60R 21/201; B60R 21/215; B60R 2021/21531; B60R 21/216; B60R 2021/0048
(Continued)

(56) References Cited

U.S. PATENT DOCUMENTS 3,787,893 A * 1/1974 Larcher ..... A42B 3/062 2/413
5,259,071 A * 11/1993 Scott ..... A42B 3/122 2/410

(Continued)

OTHER PUBLICATIONS

High tech football helmet with airbags, Retrieved from Youtube (http://www.youtube.com/watch?v=-XJrtk8MxvA), published Apr. 25, 2012, 2 pages.

(Continued)

*Primary Examiner* — Amy Vanatta
(74) *Attorney, Agent, or Firm* — Foley & Lardner LLP

(57) ABSTRACT

An airbag inflation system includes a processing circuit configured to receive object data including positional data regarding an object and at least one of a relative velocity and a relative acceleration of the object relative to a first helmet and control operation of an inflation device to inflate an airbag based on the object data.

35 Claims, 7 Drawing Sheets

(58) Field of Classification Search
USPC ..... 2/413
See application file for complete search history.

(56) References Cited

U.S. PATENT DOCUMENTS

| | | | | |
|---|---|---|---|---|
| 5,287,562 | A | 2/1994 | Rush, III | |
| 5,313,670 | A | 5/1994 | Archer, III | |
| 5,390,367 | A * | 2/1995 | Rush, III | A41D 13/018 2/413 |
| 5,402,535 | A * | 4/1995 | Green | A41D 13/018 128/DIG. 23 |
| 5,546,609 | A * | 8/1996 | Rush, III | A41D 13/018 2/413 |
| 5,621,922 | A * | 4/1997 | Rush, III | A42B 3/046 2/422 |
| 7,017,195 | B2 | 3/2006 | Buckman et al. | |
| 7,150,048 | B2 | 12/2006 | Buckman | |
| 7,477,758 | B2 * | 1/2009 | Piirainen | B60J 10/00 382/100 |
| 8,127,373 | B1 | 3/2012 | Fodemski | |
| 8,713,716 | B2 | 5/2014 | Krueger | |
| 8,947,195 | B1 * | 2/2015 | Anvari | G05B 13/02 340/3.1 |
| 2004/0183283 | A1 | 9/2004 | Buckman et al. | |
| 2005/0067816 | A1 | 3/2005 | Buckman | |
| 2008/0282453 | A1 * | 11/2008 | Alstin | A41D 13/018 2/413 |
| 2012/0102630 | A1 | 5/2012 | Anderson | |
| 2013/0118255 | A1 * | 5/2013 | Callsen | A42B 3/046 73/491 |
| 2013/0298316 | A1 * | 11/2013 | Jacob | A42B 3/12 2/414 |
| 2014/0000011 | A1 * | 1/2014 | Johnson | A42B 3/046 2/413 |
| 2015/0047101 | A1 * | 2/2015 | Korioth | A42B 1/203 2/209.13 |
| 2016/0120238 | A1 * | 5/2016 | Duncan | A41D 13/018 2/462 |
| 2016/0143383 | A1 * | 5/2016 | Allen | A42B 3/0486 2/413 |

OTHER PUBLICATIONS

Welte, Rachel, "High tech football helmet with airbags", Fox 21 News, Posted Apr. 25, 2012, 1 page.

* cited by examiner

HELMET AIRBAG SYSTEM

BACKGROUND

Various systems are used in activities such as sports, motor vehicle operation, and the like, to help reduce injuries. For example, football players typically wear a football helmet and shoulder pads to minimize the risk of injury (e.g., due to collisions with other players, the ground, etc.). Similarly, motor vehicle operators such as motorcyclists often wear helmets to minimize the risk of injury (e.g., due to collisions with other motor vehicles, etc.).

SUMMARY

One embodiment relates to a helmet airbag system, including an inflation device configured to inflate an airbag coupled to a helmet; a processing circuit configured to receive object data regarding an object and control operation of the inflation device based on the object data; and a retraction device configured to retract the airbag.

Another embodiment relates to a helmet, including an airbag; an inflation device configured to at least partially inflate the airbag; and a processor configured to predict an impact between the airbag and an object based on controlling the inflation device to inflate the airbag according to a first mode; and control operation of the inflation device to inflate the airbag according to a second mode different from the first mode based on predicting the impact.

Another embodiment relates to a helmet airbag system, including an airbag coupled to a helmet; an inflation device coupled to the helmet and configured to at least partially inflate the airbag; and a processor configured to receive object data regarding an object; predict a potential impact between the helmet and the object; and control operation of the inflation device to inflate the airbag to laterally deflect the object.

Another embodiment relates to a helmet airbag system, including an airbag coupled to a helmet; an inflation device coupled to the helmet and configured to at least partially inflate the airbag; a ventilation device coupled to the airbag and configured to deflate the airbag; and a processor configured to control operation of the inflation device and the ventilation device to selectively inflate and deflate the airbag during contact between the airbag and an object.

Another embodiment relates to a method of inflating an airbag, including receiving object data regarding an object; controlling, by a processing circuit, operation of an inflation device to inflate an airbag coupled to a helmet based on the object data; operating a retraction device to retract the airbag.

Another embodiment relates to a method of using a helmet, including predicting, by a processor, an impact between an airbag coupled to a helmet and an object based on controlling an inflation device to inflate the airbag according to a first mode; and controlling operation of the inflation device to inflate the airbag according to a second mode different from the first mode based on predicting the impact.

Another embodiment relates to a method of using a helmet, including inflating an airbag of a first helmet; and retracting the airbag with a retraction device, wherein the retraction device is configured to return the airbag to a stored position such that the airbag is usable for subsequent inflation while the first helmet is worn by a user.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
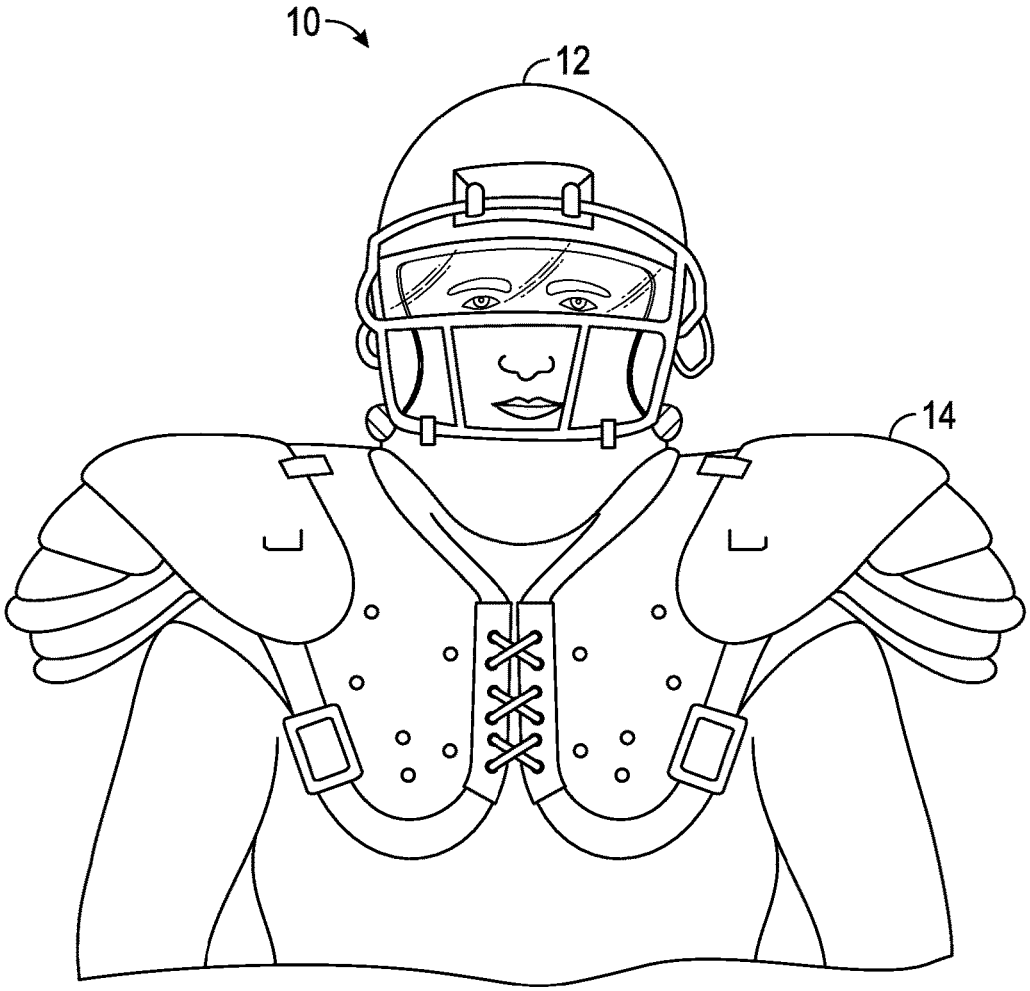
FIG. 1 is a front view of a helmet and torso protection assembly worn by a user, according to one embodiment.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to the figures generally, various embodiments disclosed herein relate to airbag inflation systems for users such as athletes, motor vehicle operators, and the like. The airbag inflation system generally includes a helmet (e.g., a "smart" helmet, a head protection assembly such as a football helmet, hockey helmet, motorcycle helmet, motocross helmet, etc.). Upon detection of an impending impact, the helmet may inflate intelligently to minimize forces and torques on its wearer. In some embodiments, the helmet may actively inflate or deflate one or more airbags to, among other things, minimize accelerations experienced by the head and neck portions of the user and reduce the risk of the user experiencing a concussion or other undesirable injuries.

Referring now to FIG. 1, airbag system 10 is shown according to one embodiment. System 10 is usable to reduce the risk of injury to users while performing various activities, including playing sports (e.g., football, hockey, baseball, etc.) and operating vehicles (e.g., bicycles, motorcycles, snowmobiles, ATVs, etc.). As shown in FIG. 1, system 10 includes helmet 12 (e.g., a head protection device or member, a first or upper protection device or member, etc.) and torso protection assembly 14 (e.g., a shoulder pad assembly, a second or lower protection device or assembly, etc.). In other embodiments, the torso protection assembly 14 may not be included. As discussed in greater detail herein, system 10 is configured to reduce impact forces to a user of helmet 12 in cases of impacts or collisions involving the user (e.g., such as collisions between players during a sporting activity, collisions between a motor vehicle operator and other motor vehicles or operators, a beanball in baseball, etc.).

Figure 2:
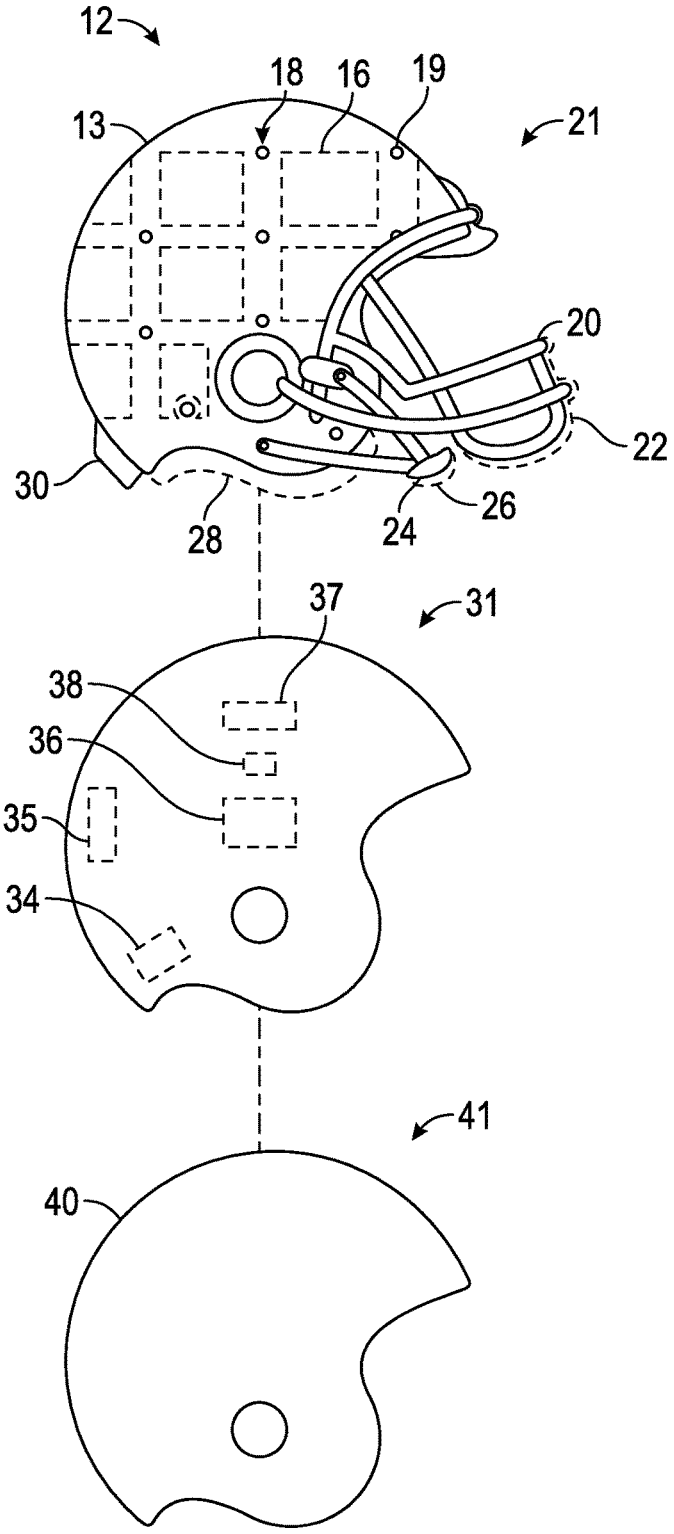
FIG. 2 is an exploded view of a helmet configuration for the helmet of FIG. 1, according to one embodiment.

Referring to FIG. 2, an exploded view of helmet 12 is shown according to one embodiment. In the example embodiment, helmet 12 is a football helmet. In other embodiments, helmet 12 may be any helmet used to protect a user from impacts to the head (e.g., during activities such as motocross, snowboarding, hockey, lacrosse, snowmobiling, etc.). In one embodiment, helmet 12 includes outer shell layer 21, processing circuit layer 31, and padding layer 41. Outer shell layer 21 includes helmet shell 13, helmet airbag array 16, sensor array 18, facemask 20, facemask airbag 22, chinstrap 24, chinstrap airbag 26, neck airbag 28, and inflation device cartridge 30. Helmet shell 13 may be structured as any type of helmet shell (e.g., football, baseball, hockey, motocross, etc.) used to protect a user's head. Helmet airbag array 16, facemask airbag 22, chinstrap airbag 26, and neck airbag 28 collectively form an airbag assembly for helmet 12. Airbags 16, 22, 26, and 28 may be disposed on the surface of helmet shell 13, internal to helmet shell 13, and/or located at any other location on or within helmet 12 to reduce an impact to a user's head, face, chin, or neck.

Sensor array 18 may be or include one or more devices (e.g., sensors, etc.) configured to measure at least one of object data of an object (or a plurality of objects) and impact data between the first helmet (e.g., helmet 12, etc.) and the object (or the plurality of objects). The object may be a second helmet, a user of a second helmet, a person or animal, or an inanimate object which is either stationary (e.g., a wall, the ground, or the like) or mobile (e.g., a vehicle, a baseball or hockey puck, or the like). Object data includes an indication of at least one of user data for a user of a second helmet, a location of the object, a direction of travel of the object, a velocity of the object, an orientation of the object, a size of the object, a shape of the object, and an acceleration of the object. The user data includes at least one of a user height, a user weight, and a user identification (e.g., same team, opposing team, etc.). The measurements of location, velocity, orientation, and acceleration of the object may be relative to helmet 12. For example, the location of the object may be a relative location, the velocity of the object may be a relative velocity, the orientation of the object may be a relative orientation, and the acceleration of the object may be a relative acceleration. Also, the location of the object may include two-dimensional location data or three-dimensional location data. Impact data may include at least one of a pressure, a force, an acceleration, and a torque applied to helmet 12 and the user of helmet 12 by an object, a second helmet, a second person, a ground surface (e.g., floor, field, road, etc.), or any other object that may cause harm to the user during a collision. In one embodiment, sensor array 18 includes one or more sensors 19 distributed about a portion of helmet shell 13, facemask 20, and/or chinstrap 24. In one embodiment, sensor array 18 may be implemented as a micropower impulse radar (MIR), a lidar, a Doppler ultrasound, or any other sensor(s) capable of determining the above mentioned characteristics (i.e., to determine object data relative to the first helmet, etc.). In one embodiment, sensor array 18 may combine sensor data regarding the first helmet (e.g., location, velocity, or acceleration determined by accelerometers, orientation determined by gyroscopes, inclinometers, or accelerometers) with externally determined data regarding the object (e.g., via one or more remote sensors) to determine object data relative to the first helmet. In one embodiment, sensory array 18 includes a temperature sensor configured to measure the temperature of air in an ambient environment (e.g., outside air, air being pumped into the airbags, air being released from the airbags, etc.). In another embodiment, sensory array 18 includes a humidity sensor configured to measure the moisture content (i.e., humidity, etc.) of the air in the ambient environment.

Still referring to FIG. 2, facemask 20 may be any type of helmet facemask configured to protect the user's face. In some embodiments, facemask 20 includes one or more crossbars, a transparent shield, or other protection devices. In yet further embodiments, facemask 20 is rigidly attached to helmet shell 13, forming a single continuous unitary outer shell (e.g., a motocross helmet, etc.), or removably attached (i.e., detachable) to helmet shell 13 (e.g., a hockey helmet, a football helmet, etc.). In yet further embodiments, facemask 20 is omitted (e.g., a baseball helmet, etc.). Facemask airbag 22 is structured to protect the users face and reduce the impact force to facemask 20 during a collision or impact. Chinstrap 24 may be any type of helmet chinstrap configured to secure helmet 12 to the user's head (e.g., by extending under or near the chin, on a portion of the neck, etc.), including a football helmet chinstrap and the like. Chinstrap airbag 26 is structured to protect the chin and front part of the neck (e.g., throat) of a user during an impact. Chinstrap airbag 26 may be disposed on the outer surface of chinstrap 24 or internal to chinstrap 24 (e.g., projecting from chinstrap 24 like that of an automobile steering wheel airbag during a collision, etc.).

Neck airbag 28 is structured to inflate along the posterior and side portions of the user's neck from the underside of helmet 12. In some embodiments, neck airbag 28 may couple to torso protection assembly 14 via a coupling mechanism to resist relative movement between helmet 12 and torso protection assembly 14 in order to further reduce risk of injury to the user of system 10. In other embodiments, the inflated neck airbag 28 may rest on the collarbone or shoulders of the user. In further embodiments, neck airbag 28 may inflate to take the shape of a neck brace (e.g., neck collar, neck pillow, etc.). In alternate embodiments, any one of helmet airbag array 16, facemask airbag 22, chinstrap airbag 26, and neck airbag 28 may or may not be included with helmet 12.

Figure 3:
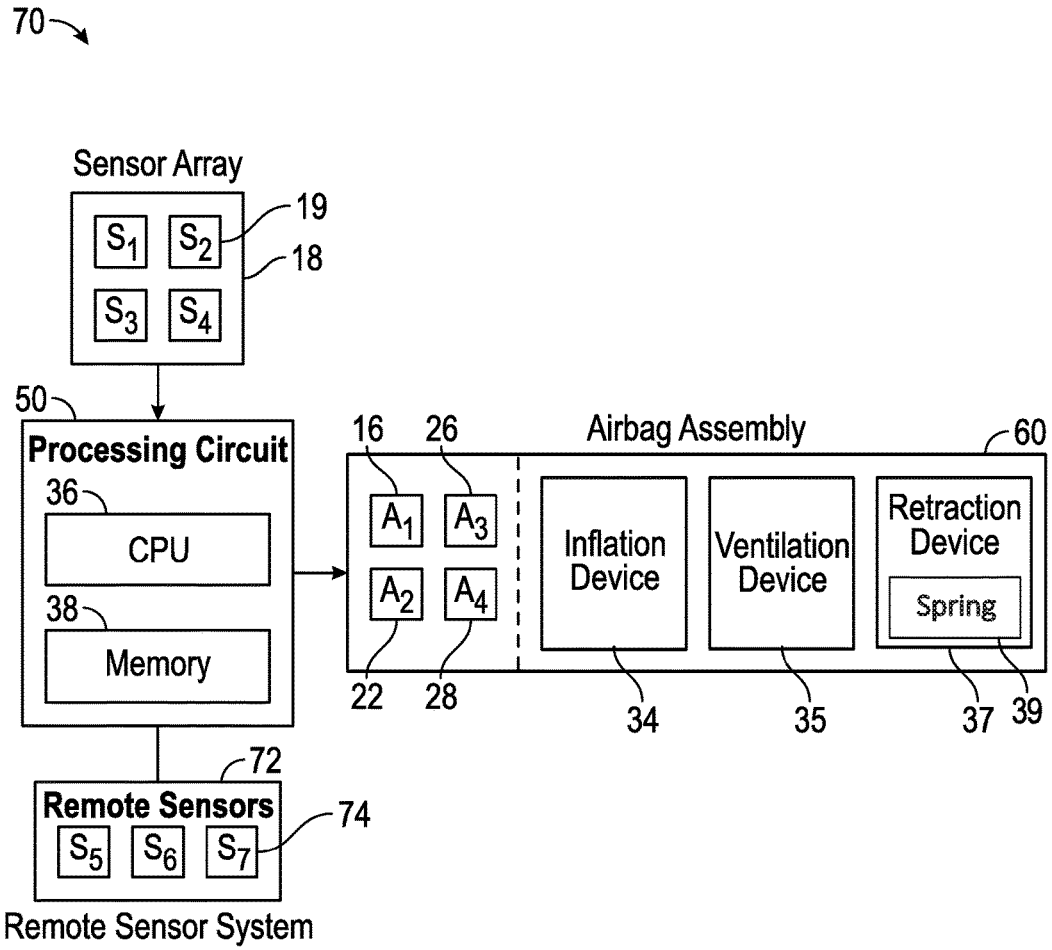
FIG. 3 is a control system for the helmet of FIG. 2, according to one embodiment.

Inflation device cartridge 30 is structured to store chemicals which when released chemically react to produce gas, and/or compressed gas to be used to inflate one or more airbags of airbag assembly 60 (see FIG. 3). Cartridge 30 may be provided at any suitable location on or within helmet 12 (e.g., within or outside shell layer 21, etc.).

Processing circuit layer 31 is shown to include inflation device 34, ventilation device 35, processor 36, retraction device 37, and memory 38. In the example embodiment, processing circuit layer 31 is shown as its own layer within helmet 12 between outer shell layer 21 and padding layer 41. In other embodiments, processing circuit layer 31 and its respective components may be included in outer shell layer 21, padding layer 41, or another location of helmet 12. Processing circuit layer 31 is shown as its own layer for clarity and for illustrative purposes only. Inflation device 34 is configured to at least partially inflate one or more of the airbags (e.g., helmet airbag array 16, facemask airbag 22, chinstrap airbag 26, neck airbag 28, etc.) of helmet 12. Inflation device 34 may inflate the one or more airbags through a chemical reaction to produce gas, or alternatively, may release compressed gas from inflation device cartridge 30. In some embodiments, inflation device 34 is or includes a pump device configured to pump ambient air from an external environment (e.g., outside of the airbags, etc.) to inflate the one or more airbags. Inflation device cartridge 30 may be structured as an interchangeable cartridge which may be replaced when fully depleted. In one embodiment, cartridge 30 carries five gas generators (e.g., chemical reactants, compressed gas containers, etc.). When all five gas generators have been used for airbag inflations, cartridge 30 may be removed and a new cartridge 30 may be inserted into helmet 12. In other embodiments, the number of gas generators may be less than or greater than five. In further embodiments, cartridge 30 is not removable from helmet 12, and serves as a fixed reservoir within helmet 12 that is refillable with compressed gas or other materials (e.g., chemical reactants, etc.) via a nozzle mechanism attached to helmet 12.

Ventilation device 35 is configured to at least partially deflate one or more of the airbags (e.g., helmet airbag array 16, facemask airbag 22, chinstrap airbag 26, neck airbag 28, etc.) of helmet 12. Ventilation device 35 may deflate the one or more airbags through releasing (e.g., venting, expelling, etc.) a portion of the gas within the one or more airbags. Retraction device 37 is configured to retract one or more inflated airbags of helmet 12 to a stored position (e.g., a previous position before inflation, etc.) when the impact is completed or there is no relatively immediate potential for other impacts. Retraction device 37 may retract one or more airbags by at least one of pulling internal/external fibers attached to the airbag(s), pulling a net around the airbag(s), applying a vacuum to the airbag(s), reacting with magnets on the airbag, and any other method of retracting an airbag.

Processor 36 may be implemented as a general-purpose processor, an application specific integrated circuit (ASIC), one or more field programmable gate arrays (FPGAs), a digital-signal-processor (DSP), a group of processing components, or other suitable electronic processing components. Memory 38 is one or more devices (e.g., RAM, ROM, Flash Memory, hard disk storage, etc.) for storing data and/or computer code for facilitating the various processes described herein. Memory 38 may be or include non-transient volatile memory or non-volatile memory. Memory 38 may include database components, object code components, script components, or any other type of information structure for supporting the various activities and information structures described herein. Memory 38 may be communicably connected to processor 36 and provide computer code or instructions to processor 36 for executing the processes described herein.

Padding layer 41 includes helmet padding 40 which may be any type of helmet padding for added head protection to the user (e.g., foam padding, inflatable pads, etc.). In other embodiments, padding layer 41 may also serve the purpose of housing at least one of the components shown in processing circuit layer 31. Padding layer 41 may include multiple individual cushioning elements according to some embodiments.

Referring now to FIG. 3, control system 70 for controlling operation of helmet 12 is shown according to one embodiment. Control system 70 includes sensor array 18, processing circuit 50, and airbag assembly 60. Sensor array 18 may be one or more devices (e.g., sensors, micropower impulse radar, lidar, cameras, etc.) that acquire at least one of object data and impact data that may then be relayed and received by processing circuit 50. In some embodiments, control system 70 includes remote sensor system 72 to acquire data. In some embodiments, control system 70 includes a wireless receiver to acquire data from a remote device (e.g., remote sensor system 72, a database, etc.).

Processing circuit 50 includes processor 36 and memory 38. Processing circuit 50 is configured to control operation of airbag assembly 60. Airbag assembly 60 includes airbags 16, 22, 26, and 28, inflation device 34, ventilation device 35, and retraction device 37. In one embodiment, processing circuit 50 controls operation of airbag assembly 60 based on sensor data from sensor array 18 and/or other inputs and data. For example, in some embodiments, stored data in memory 38 and object data measured by sensor array 18 may be compared to determine if a threshold (e.g., a user defined impact parameter, etc.) has been reached. If so, processor 36 controls the inflation of airbag assembly 60 via inflation device 34. The threshold may be used to predict the imminence of a potential impact, by including an expected time until an impact, a speed of an impacting body, the size of an impacting body, a distance between impacting bodies or other characteristics defined by the object data. In other embodiments, sensor array 18 is configured to measure at least one of a force, a torque, a pressure, and an acceleration (e.g., on the helmet, of an impacting object or person, relative acceleration(s), etc.) to define impact data of an actual impact between helmet 12 and another object (e.g., the ground, a second helmet, etc.); inflation of the airbag may be controlled by comparing such impact data to corresponding threshold values.

In some embodiments, processing circuit 50 is configured to receive remote sensor data from remote sensor system 72. Remote sensor system 72 includes one or more remote sensors 74 (e.g., still or video cameras, radar devices, GPS, etc.) configured to acquire data (e.g., position, velocity, acceleration, orientation, etc.) regarding one or more user, objects, etc. The remote sensor data may include object data for one or more helmets or other objects, user data for one or more users, etc. As such, processing circuit 50 may, in some embodiments, be configured to predict one or more potential impacts based on the remote sensor data received from remote sensor system 72. Remote sensors 74 may be arranged in a user area, such as a football field, street area, and the like.

The force and/or torque applied to the user by an impacting object may cause pressure change in an airbag and substantial accelerations on the user (e.g., the user's head inside of the helmet, etc.). In some embodiments, the pressure is increased in the airbags of airbag assembly 60 during an impact by an impacting object by reducing the volume of an airbag while the amount of gas in the airbag remains substantially constant. The increase in pressure may be useful in determining the magnitude of the impact. The accelerations are produced by an impacting object causing helmet 12 (e.g., the user, etc.) to slow down, speed up, change direction, and the like. Data regarding the acceleration is useful in determining the magnitude of the impact in order to reduce further accelerations of the user's head throughout the collision. Adapting to the impact data to reduce the force, torque, pressure, and/or acceleration is described more fully herein.

Based on the object data received by processor 36 from sensor array 18 and/or remote sensor system 72, processor 36 controls operation of inflation device 34 to selectively inflate one or more airbags of airbag assembly 60. For example, processor 36 may control an inflation rate, a timing of inflation, and an inflation pressure of the airbag(s) of the airbag assembly 60 via inflation device 34. Processor 36 is configured to control operation of at least one of inflation device 34 and ventilation device 35 to selectively inflate or deflate each of the plurality of airbags of airbag assembly 60 to reduce forces and torques applied to the user of helmet 12 based on the impact data. For example, processor 36 may actively control at least one of a deflation rate, an inflation rate, a deflation pressure, and an inflation pressure of the airbag(s) of airbag assembly 60 during an impact based on the impact data. The active control may be achieved by at least one of venting gas from the airbag (e.g., via ventilation device 35, etc.), supplying gas (e.g., from a chemical reaction, from a compressed gas container, from an ambient environment, etc.) to the airbag (e.g., via inflation device 34, etc.), and controlling a shape of the airbag (e.g., by at least one of inflation device 34, ventilation device 35, retraction device 37, etc.). Venting gas from the airbag or supplying gas to the airbag may be performed to maintain a desired pressure or force on helmet 12 or on another object involved in the impact (e.g., other helmet, person, etc.). The desired pressure or force may be a constant, or may be some other desired time profile.

Controlling the shape of the airbag may be performed to control the direction of applied force and/or to limit the torque applied to helmet 12 or another object. The shape may be controlled by pulling on internal/external fibers of the airbag, inflating the airbag within a properly shaped net, controlling the pressure in sub-compartments of the airbag, or other airbag shape control methods. In one embodiment, airbag assembly 60 may include pre-shaped airbags configured to be selectively inflated to laterally deflect incident objects (e.g., an impacting helmet, etc.) from helmet 12. For example, one or more airbags may have a shape with sloped sides (e.g., conical shaped, wedge shaped, etc.). In another example, multiple small airbags or multiple compartments of an airbag may be differentially inflated (e.g., to different sizes and pressures to create a specific shape, etc.) to laterally deflect a potentially impacting object. The inflation timing of multiple small airbags may be tailored so that the impacting object laterally bounces from one airbag to another. In yet another example, the airbag may be inflated off-center (e.g., to one side, opposite to that of the desired deflection, etc.) of a projected impact site (e.g., location on helmet 12, etc.). By inflating the airbag off-center, in some cases, additional rotation of the head and neck of the user of helmet 12 may be substantially minimized.

In one embodiment, processor 36 may be configured to control operation of retraction device 37. For example, after an impact, processor 36 may control retraction device 37 to retract one or more airbags of airbag assembly 60 with actively controlled pulling of fibers pre-attached to the airbag, actively controlled pulling of nets around the airbag, and/or applying negative pressure (e.g., a vacuum, etc.) inside the airbag. In other embodiments, the retraction of one or more airbags of airbag assembly may be independent of processor 36. The retraction of the airbags of airbag assembly 60 may be a mechanical retraction (e.g., spring action, etc.). For example, airbag assembly 60 may always have a tension force applied to each airbag (e.g., the airbag fibers, a net surrounding the airbag, etc.) with a spring 39. When inflation device 34 inflates one of the airbags (e.g., helmet airbag array 16, facemask airbag 22, chinstrap airbag 26, neck airbag 28, etc.), the tension force of spring 39 is overcome by the pressure of the gas inflating the airbag, deploying the airbag from helmet 12. Once the airbag is ready for retraction, ventilation device 35 vents (e.g., releases, etc.) the gas within the airbag. The tension force applied by spring 39 retracts the airbag to its original location to await a subsequent inflation. In some embodiments, when retraction device 37 retracts the airbag(s), the gas within the airbag(s), which would otherwise be expelled into the surrounding environment, may be accumulated by an accumulation device to be reused in future airbag inflations.

Figure 4A:
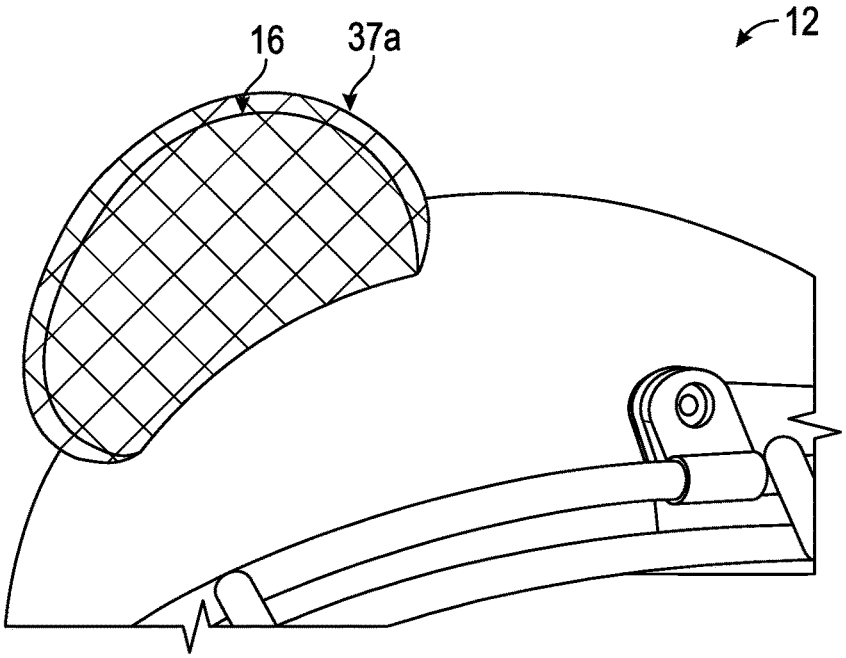
FIG. 4A is an illustration of an airbag refraction device, according to one embodiment.

Referring now to FIG. 4A, in one embodiment, retraction device 37 includes a net, shown as airbag retraction net 37*a*. As shown in FIG. 4A, airbag refraction net 37*a* surrounds an individual airbag of helmet airbag array 16. A plurality of airbag retraction nets 37*a* may be included to surround each of the airbags of helmet airbag array 16. In other embodiments, airbag retraction net 37*a* may surround any of the airbags of airbag assembly 60 (e.g., helmet airbag array 16, facemask airbag 22, chinstrap airbag 26, neck airbag 28, etc.). In some embodiments, airbag retraction net 37*a* may be used to affect a specific shape (e.g., conical shaped, wedge shaped, etc.) to an inflated airbag. By way of example, retraction device 37 may be retractably controlled by processor 36 to retract airbag retraction net 37*a*. For example, following an impact, processor 36 commands retraction device 37 to pull on the ends of airbag retraction net 37*a* to return an airbag to a stored position (e.g., the position prior to inflation, etc.). In another embodiment, retraction device 37 may be a mechanical device (e.g., spring, etc.) that applies tension to the ends of airbag retraction net 37*a* to return an airbag to a stored position, as described above.

Figure 4B:
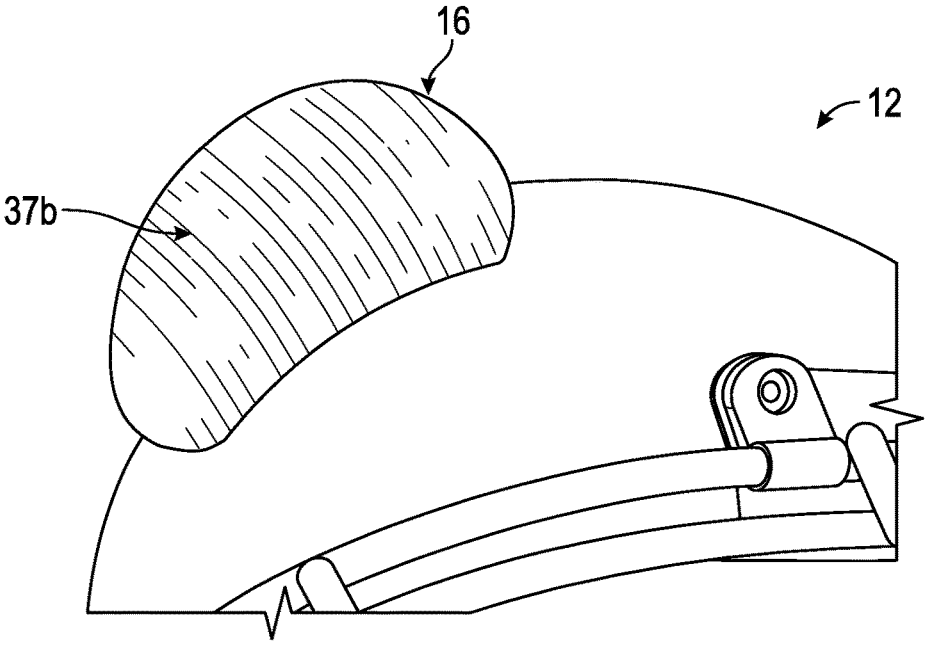
FIG. 4B is an illustration of an airbag retraction device, according to another embodiment.

Referring now to FIG. 4B, in another embodiment, an airbag of helmet airbag array 16 includes fibers, shown as airbag fibers 37*b*. The airbag fibers 37*b* are disposed within the structure of the airbag. In other embodiments, the structure of each of the airbags of airbag assembly 60 (e.g., helmet airbag array 16, facemask airbag 22, chinstrap airbag 26, neck airbag 28, etc.) may include airbag fibers 37*b*. In one embodiment, airbag fibers 37*b* are elastic, which allows them to expand and retract without hindering the expansion of the airbag. In other embodiments, airbag fibers 37*b* define an inflated shape (e.g., conical shaped, wedge shaped, etc.) of an inflated airbag. By way of example, retraction device 37 may be retractably controlled by processor 36 to retract any of the airbags of airbag assembly 60 by pulling on the ends of airbag fibers 37*b* to return an airbag to a stored position (e.g., the position prior to inflation, etc.). In another embodiment, retraction device 37 may be a mechanical device (e.g., a spring, independent of processor 36, etc.) that applies tension to the ends of airbag fibers 37*a* to return an airbag to a stored position, as described above.

In a further embodiment, retraction device 37 may be or include a pump. The pump may be configured to apply negative pressure (e.g., a vacuum, etc.) to remove gas from within an inflated airbag. For example, following an impact, processor 36 activates the pump of retraction device 37 to remove the gas from one or more airbags to return the airbag(s) to a stored (e.g., uninflated, etc.) position.

In an embodiment where airbag system 10 inflates the one or more airbags with ambient air, processor 36 may be configured to control inflation device 34, ventilation device 35, and/or retraction device 37 responsive to the temperature and/or moisture content of the ambient air. As described above, sensor array 18 may include a temperature sensor and/or a humidity sensor. Therefore, processor 36 may control the inflation and/or deflation of the airbags at least partially responsive to temperature and humidity measurements acquired by the temperature and humidity sensors. Temperature of air may affect the pressure and volume of an airbag as the airbag is inflated. For example, warmer air may require a lesser quantity (e.g., of mass, of moles, etc.) of air to inflate an airbag to a desired pressure and/or volume relative to cooler air. By monitoring temperature, processor 36 may be able to substantially prevent over or under inflation of an airbag of airbag system 10. Moisture of air may cause moisture pockets to form within an airbag. The moisture pockets may affect deployment of the airbags. For example, moisture may lead to degradation and/or inefficient deployment.

Figure 5:
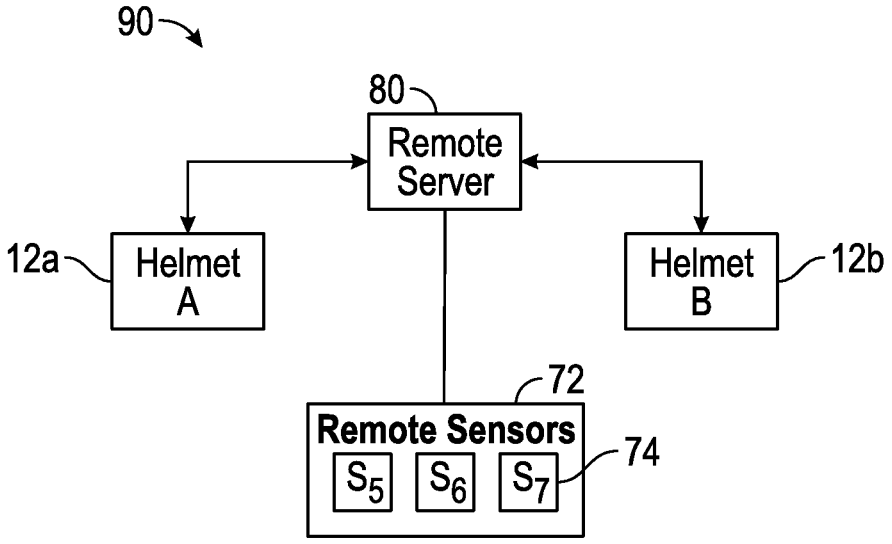
FIG. 5 is a schematic diagram of communication between a remoter server and a first and a second helmet, according to one embodiment.

Referring now to FIG. 5, a first helmet, shown as helmet 12*a*, and a second helmet, shown as helmet 12*b*, are shown to be in communication with an external server, shown as remote server 80. In some embodiments, remote server 80 may include a device such as a global camera or sensor system, shown as remote sensor system 72, that monitors one or more helmets within the system, shown as helmet monitoring system 90, using remote sensors 74. Helmet monitoring system 90 makes coordinated decisions, via a processor and memory (e.g., like processor 36 and memory 38, etc.), as to which airbag assemblies of at least one of the first helmet and the second helmet to inflate. As shown in FIG. 5, helmet monitoring system 90 includes two helmets. In other embodiments, helmet monitoring system 90 may include any plurality of helmets (e.g., one, three, eleven, twenty-two, etc.).

In one embodiment, helmet 12*a* and helmet 12*b* may use their respective sensor arrays (e.g., like that of sensor array 18, etc.) to acquire and relay information (e.g., impact data, helmet data, object data, etc.) to remote server 80. Using the relayed information, remote server 80 may communicate inflation instructions (i.e., predictive inflation, etc.) and/or impact instructions (e.g., inflate airbag, deflate airbag, control shape of airbag, etc.) to a least one of helmet 12*a* and helmet 12*b*. For example, remote server 80 may command helmet 12*a* to inflate certain airbags. As a result, impact forces and/or accelerations experienced by the head and neck portions of the user may be minimized and the risk of the user experiencing a concussion or other undesirable injuries may be reduced. In another embodiment, remote server 80 acquires data (e.g., object data, etc.) via the remote sensor system 72. The data allows remote server 80 to determine the relative position, relative velocity, and/or relative acceleration of the second helmet relative to the first helmet to predict at least one of a time-to-impact, if the second helmet may reach a designated keep-out-envelope around the first helmet, and the strength of the potential impact between the first helmet and the second helmet. Thereby, the processor (e.g., like processor 36, etc.) of remote server 80 determines whether to instruct at least one of helmet 12*a* and helmet 12*b* to inflate one or more airbags before a potential impact based on the object data (i.e., predictive inflation, etc.).

Figure 6:
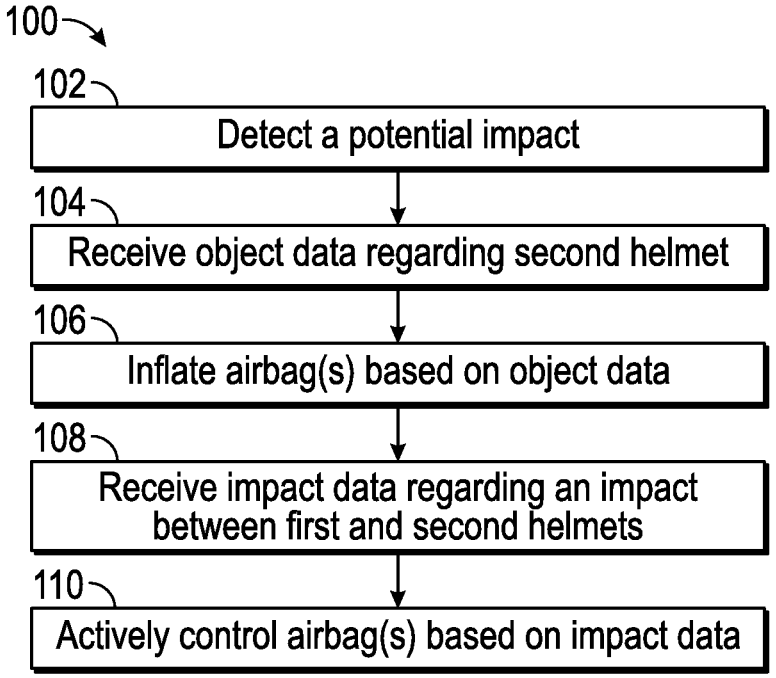
FIG. 6 is a block diagram of a method of inflating an airbag, according to one embodiment.

Referring now to FIG. 6, method 100 of inflating an airbag is shown according to an example embodiment. In one example embodiment, method 100 may be implemented with helmet 12 and control system 70 of FIGS. 2-3. Accordingly, method 100 may be described in regard to FIGS. 2-3. In another example embodiment, method 100 may be implemented with helmet monitoring system 90 of FIG. 5. Accordingly, method 100 may also be described in regard to FIG. 5.

At 102, a potential impact is detected and predicted. In one embodiment, a remote server (e.g., remote sensor system 72, remote server 80, etc.) or a first helmet (e.g., helmet 12, etc.) detects the potential impact. For example, when an athlete in football is running with the ball, the athlete's helmet may continually scan the field for potential impacts from other players, the ground, and other possible sources of impacts via sensor array 18. At 104, object data regarding an object, such as a second helmet, is received (e.g., by the remote server, the first helmet, etc.). As mentioned above, the object data may include at least one of an indication of at least one of user data for a user of the second helmet, a location (e.g., relative location, etc.) of the second helmet, a direction of travel of the second helmet, a velocity (e.g., relative velocity, etc.) of the second helmet, an orientation of the second helmet, and an acceleration (e.g., relative acceleration, etc.) of the second helmet. Each helmet may include a radio-frequency identification (RFID) tag embedded therein to identify the user (e.g., to supply the first helmet with user data, etc.). In some embodiments, other equipment (e.g., torso protection assembly 14, knee pads, shoes, etc.) may include additional RFID tags. The identification may allow a server or the first helmet to obtain information such as the second user's height, weight, team, or any other pertinent characteristics.

At 106, one or more airbags are inflated based on the object data. In one embodiment, processor 36 of the first helmet determines whether to inflate one or more airbags before a potential impact based on the object data or what may be referred to as predictive inflation. Processor 36 of the first helmet may use the knowledge of relative position, relative velocity, and/or relative acceleration of the second helmet (or other object) relative to the first helmet to predict a time-to-impact. Thereby, the first helmet may predict a finite time-to-impact (e.g., when a collision will occur, etc.) or an infinite time-to-impact (e.g., when a collision will not occur, etc.). Processor 36 of the first helmet may inflate one or more airbags of airbag assembly 60 via inflation device 34 if the time-to-impact is within a defined range of times (e.g., short enough to be inevitable, longer than airbag inflation time, etc.).

Processor 36 may also use the known position, velocity, and/or acceleration of the second helmet relative to the first helmet to predict if the second helmet will reach a designated keep-out-envelope around the first helmet (e.g., within 5 cm, 10 cm, 20 cm, etc.). If the keep-out-envelope is predicted to be penetrated, processor 36 may inflate one or more airbags of airbag assembly 60 via inflation device 34 prior to the second helmet impacting the first helmet. If the second helmet is predicted to not enter the keep-out-envelope around the first helmet, but instead pass nearby (e.g., not impact the first helmet, etc.), processor 36 of the first helmet prevents inflation of airbag assembly 60.

Similarly, processor 36 may further use the known relative position, relative velocity, and/or relative acceleration of the second helmet relative to the first helmet to predict the strength or magnitude of the potential impact. If the strength is too small (e.g., presents no risk of causing injury to the user of the first helmet or second helmet, etc.), processor 36 does not inflate airbag assembly 60. If the strength is relatively large (e.g., presents a risk of causing injury, etc.), processor 36 may inflate one or more airbags of airbag assembly 60 via inflation device 34 and control the amount of inflation based on the predicted impact strength. For example, processor 36 may control which airbags to inflate and to what pressure, size, and shape to limit the amount of force and/or torque applied to or by the second helmet. Airbag inflation may also be spatially dependent. For example, processor 36 may only inflate airbag assembly 60 in a pre-designated region and the impact occurs in the pre-designated region (e.g., while on the field, court, ice rink, etc.). It should be noted that in some embodiments, processor 36 is located remotely from the first and second helmets (e.g., as part of remote server 80, helmet monitoring system 90, etc.).

At 108, impact data is received (e.g., by the first helmet, the remote server, etc.) regarding an impact between the first and second helmets. As mentioned above, the impact data may include at least one of a pressure, a force, an acceleration, and a torque applied to the first helmet by the second helmet (or a second person, the ground, or any other object that may be involved in a collision). At 110, processor 36 of the first helmet (or of the remoter server) actively controls one or more airbags of airbag assembly 60 via at least one of inflation device 34 and ventilation device 35 based on the impact data. As mentioned above, processor 36 is configured to selectively inflate or deflate each of the plurality of airbags of airbag assembly 60 (e.g., actively control at least one of a deflation rate, an inflation rate, a deflation pressure, an inflation pressure, etc. of the airbag(s) of airbag assembly 60 during an impact) to reduce forces and torques applied to the user of the first helmet and/or second helmet. The active control may be achieved by at least one of venting gas from the airbag, supplying gas to the airbag, and controlling a shape of the airbag (e.g., inflating subparts of an airbag, deflating subparts of an airbag, etc.).

Method 100 is shown to encompass two helmets. In other embodiments, method 100 may involve a plurality of helmets where coordinated decisions with regards to airbag inflation (e.g., when three or more users of helmets, like helmet 12, impact each other concurrently, etc.) may need to be made. In further embodiments, method 100 may only involve a single helmet and potential/actual impacts with the ground or other objects (e.g., walls, posts, trees, vehicles, etc.). Also, method 100 is shown from the perspective of the first helmet. In other embodiments, method 100 may be implemented by the second helmet or jointly implemented by the first and second helmet. As noted above, in some embodiments, airbag inflation, deflation, and refraction instructions may be provided from a remote source (e.g., remote server 80, etc.).

Figure 7:
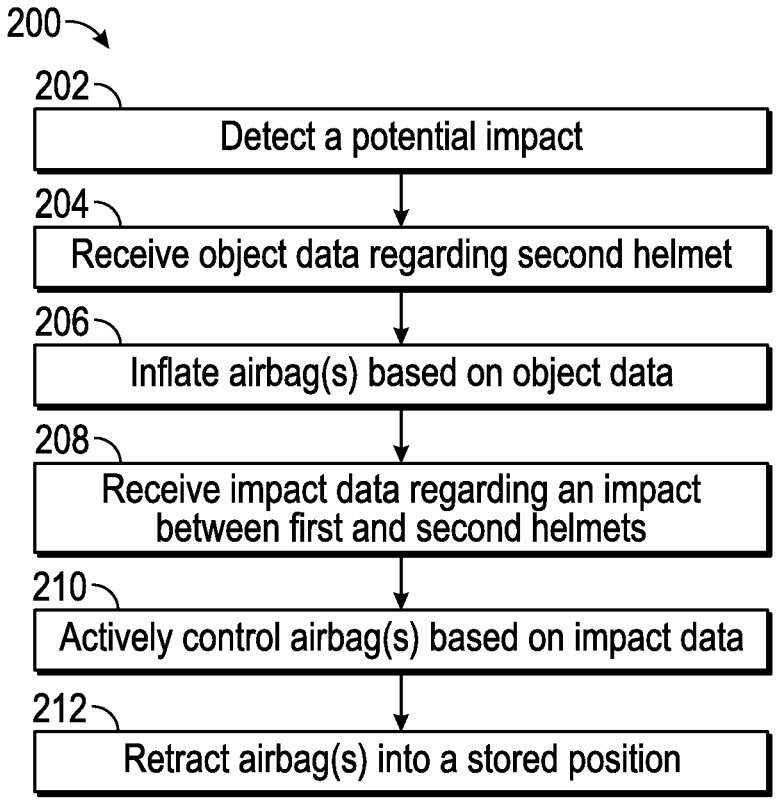
FIG. 7 is a block diagram of a method of inflating and retracting an airbag, according to one embodiment.

Referring now to FIG. 7, method 200 of inflating and retracting an airbag is shown according to an example embodiment. In one example embodiment, method 200 may be implemented with helmet 12 and control system 70 of FIGS. 2-3. Accordingly, method 200 may be described in regard to FIGS. 2-3. In another example embodiment, method 200 may be implemented with helmet monitoring system 90 of FIG. 5. Accordingly, method 200 may also be described in regard to FIG. 5.

At 202, a potential impact is detected and/or predicted. In one embodiment, a remote server (e.g., remote sensor system 72, remote server 80, etc.) or a first helmet (e.g., helmet 12, etc.) detects a potential impact. For example, when an athlete in football is running with the ball, the athlete's helmet may continually scan the field for potential impacts from other players, the ground, and other possible sources of impacts via sensor array 18. At 204, object data (e.g., user data, relative location, relative velocity, relative acceleration, etc.) regarding a second helmet is received (e.g., by the remote server, the first helmet, etc.). Each helmet may include a RFID tag embedded therein to identify the user (e.g., to supply the first helmet with user data such as the second user's height, weight, team, etc.).

At 206, one or more airbags is inflated based on the object data. In one embodiment, processor 36 of the first helmet determines whether to inflate one or more airbags before a potential impact based on the object data (i.e., predictive inflation, etc.). Processor 36 of the first helmet may use the known relative position, relative velocity, and/or relative acceleration of the second helmet (or other object) relative to the first helmet to predict at least one of a time-to-impact, if the second helmet may reach a designated keep-out-envelope around the first helmet, and the strength of the potential impact. Processor 36 of the first helmet may inflate one or more airbags of airbag assembly 60 via inflation device 34 based on the predicted time-to-impact being within a defined range of times (e.g., short enough to be inevitable, longer than airbag inflation time, etc.), the keep-out-envelope is predicted to be penetrated, and/or the predicted strength of the impact being substantial enough to potentially cause injury. Airbag inflation may also be spatially dependent. For example, processor 36 may only inflate airbag assembly 60 in a pre-designated region and the impact occurs in the pre-designated region. It should be noted that in some embodiments, processor 36 is located remotely from the first and second helmets (e.g., as part of remote server 80, helmet monitoring system 90, etc.).

At 208, impact data is received (e.g., by the first helmet, the remote server, etc.) regarding an impact between the first and second helmets. As mentioned above, the impact data may include at least one of a pressure, a force, an acceleration, and a torque applied to the first helmet by the second helmet (or a second person, the ground, or any other object that may be involved in a collision). At 210, processor 36 of the first helmet (or the remote server) actively controls one or more airbags of airbag assembly 60 via at least one of inflation device 34 and ventilation device 35 based on the impact data. As mentioned above, processor 36 is configured to selectively inflate or deflate each of the plurality of airbags of airbag assembly 60 (e.g., actively control at least one of a deflation rate, an inflation rate, a deflation pressure, an inflation pressure, etc. of the airbag(s) of airbag assembly 60 during an impact) to reduce forces and torques applied to the user of the first helmet and/or second helmet. The active control may be achieved by at least one of venting gas from the airbag, supplying gas to the airbag, and controlling a shape of the airbag (e.g., inflating subparts of an airbag, deflating subparts of an airbag, etc.).

At 212, the inflated airbag(s) of airbag assembly 60 are retracted into a stored position via refraction device 37. As mentioned above, retraction device 37 may retract one or more airbags by at least one of pulling internal/external fibers attached to the airbag(s), pulling a net around the airbag(s), and/or applying a vacuum to the airbag(s). In one embodiment, processor 36 (e.g., of the first helmet, the remote server, etc.) may command refraction device 37 to retract one or more airbags of airbag assembly 60. In other embodiments, the retraction of the airbags of airbag assembly 60 may be a mechanical refraction with a preload tension (e.g., spring action, etc.). In either case, once the impact has gone to completion (e.g., no potential impacts imminent, etc.), the retraction device 37 retracts any of the airbags inflated from the first helmet into an original pre-inflation location (e.g., within the helmet, etc.). At this point, the first helmet may detect a second potential impact via sensor array 18, and the process of 202-212 (e.g., method 200, etc.) may be repeated, inflating one or more airbags if another helmet, object, ground, post, vehicle, etc. is predicted to collide (e.g., cause a substantial impact, enter the keep-out-envelop, etc.) with the first helmet.

Method 200 is shown to encompass two helmets. In other embodiments, method 200 may involve a plurality of helmets where coordinated decisions with regards to airbag inflation (e.g., when three or more users of helmets, like helmet 12, impact each other concurrently, etc.) may need to be made. In further embodiments, method 200 may only involve a single helmet and potential/actual impacts with the ground or other objects (e.g., walls, posts, trees, vehicles, etc.). Also, method 200 is shown from the perspective of the first helmet. In other embodiments, method 200 may be of implemented by the second helmet or jointly implemented by the first and second helmet. As noted above, in some embodiments, airbag inflation, deflation, and retraction instructions may be provided from a remote source (e.g., remote server 80, etc.).

In some embodiments, processing circuit 50 is configured to modify an inflation mode or protocol based on a potential impact. For example, processing circuit 50 may predict an impact based on inflating one or more airbags according to a first mode. The first mode may define various inflation or deployment parameters for an airbag, including, but not limited to, threshold parameters (e.g., for force, torque, velocity, acceleration, etc.) that trigger inflation of the airbag, an inflation timing, rate, or pressure, a selection of which airbags to inflate, etc. Processing circuit 50 may be further configured to determine a second mode for inflating one or more airbags based on the predicted impact (e.g., impact data such as that disclosed herein). The predicted impact data may include a time of the impact, a collision location on the helmet, an impulse applied to the helmet, a force applied to the helmet, a torque applied to the helmet, a post-impact motion of the helmet, a force applied to a user of the helmet, a torque applied to a user of the helmet, a post-impact motion of a user of the helmet, an impulse applied to the object, a force applied to the object, a torque applied to the object, a post-impact motion of the object, damage to the helmet, damage to a user of the helmet, damage to the object, or the like. Aspects of this predicted impact data may be sufficiently undesirable, so that the processing circuit decides to forego inflation via the first mode, and instead implements a second mode of airbag inflation. The second mode may be different from the first mode and alter one or more of the inflation or deployment parameters for one or more airbags. The second mode may be determined based on avoiding an impact altogether, laterally deflecting an object, or reducing various impact forces, torques, etc. In one embodiment, controlling an airbag according to a second mode includes not inflating one or more airbags; for example in situations where an object would (in the absence of inflation) miss the helmet, but inflation via the first mode would lead to an impact.

Figure 8:
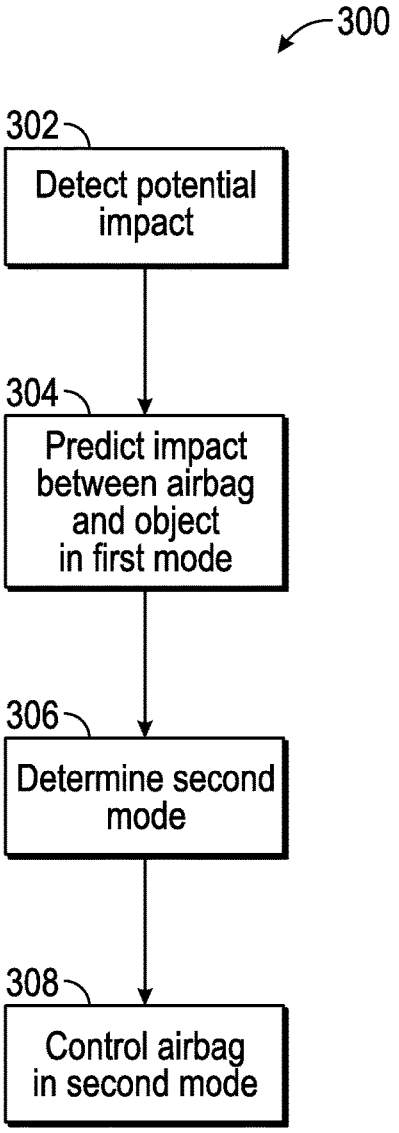
FIG. 8 is a block diagram of a method of controlling one or more airbags according to various modes according to one embodiment.
Figure 9:
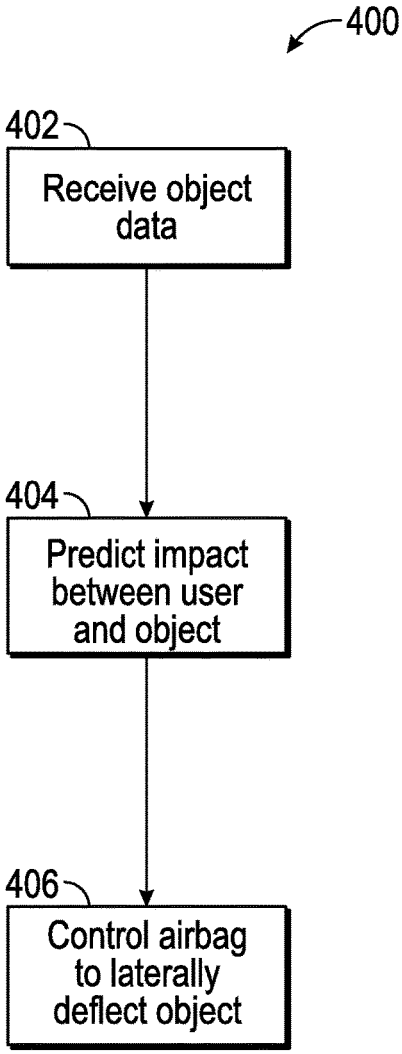
FIG. 9 is a block diagram of a method of controlling an airbag according to one embodiment.

Referring to FIG. 8, method 300 of controlling one or more airbags according to various modes is shown according to one embodiment. In one example embodiment, method 300 may be implemented with helmet 12 and control system 70 of FIGS. 2-3. Accordingly, method 300 may be described in regard to FIGS. 2-3. In another example embodiment, method 300 may be implemented with helmet monitoring system 90 of FIG. 5. Accordingly, method 300 may also be described in regard to FIG. 5.

At 302, a potential impact is detected or predicted. In one embodiment, a processing circuit such as processing circuit 50 detects a potential impact between a helmet and an object (e.g., another user or an inanimate object, etc.) based on various data (e.g., object data, user data, etc.). At 304, an impact is predicted between an airbag and the object. In one embodiment, processing circuit predicts an impact between one or more airbags and an object based on inflating the airbags according to a first mode. The first mode may define any of the parameters discussed herein. At 306, a second mode is determined. The second mode is different from the first mode in that one more of the inflation parameters differs between the two modes. The second mode is determined based on avoiding, or reducing the magnitude of, an impact. At 308, the airbag controlled according to the second mode. Controlling the airbag according to the second mode may include not inflating the airbag, inflating one or more airbags to laterally deflect an object, inflating an airbag to minimize potential injuries, and the like.

Referring now to FIG. 400, in some embodiments, one or more airbags may be controlled/inflated so as to laterally deflect an object (e.g., to reduce forces and/or accelerations experienced by one or more users, etc.). Airbag control may include any or all of controlling whether to inflate one or more airbags of a plurality of airbags, controlling an inflation timing, pressure, rate, etc., controlling an airbag shape, and the like. In some embodiments, one or more airbags may include sloped sides and/or be conical, wedge, or otherwise shaped. Multiple airbags may be differentially inflated (e.g., in terms of pressure, size, timing, etc.) to laterally deflect an object (e.g., such that an object laterally bounces from one airbag to the next, etc.). As noted above, the shape of one or more airbags may be controlled by way of a net, fibers, etc.

In one example embodiment, method 400 may be implemented with helmet 12 and control system 70 of FIGS. 2-3. Accordingly, method 400 may be described in regard to FIGS. 2-3. In another example embodiment, method 400 may be implemented with helmet monitoring system 90 of FIG. 5. Accordingly, method 400 may also be described in regard to FIG. 5. At 402, object data is received. The object data may be received by a processing circuit or sever and include any of the types of object or user data disclosed herein. At 404, an impact is predicted between a user and the object. In one embodiment, an impact is predicted based on the user data and/or data regarding a helmet worn by a user (e.g., helmet data, etc.). At 406, one or more airbags is controlled to laterally deflect the object. As noted above, a processing circuit or remote server may control various inflation parameters in order to provide lateral deflection of an object.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A helmet airbag system, comprising:
an inflation device configured to inflate an airbag coupled to a helmet;
a ventilation device configured to deflate the airbag;
a processing circuit configured to:
receive object data regarding at least one of an actual impact and a predicted impact between the helmet and an object; and
control operation of the ventilation device and the inflation device to control at least one of a deflation rate and an inflation rate of the airbag based on the object data; and
a retraction device configured to retract the airbag.

2. The system of claim 1, wherein the object data comprises an indication of at least one of a location, a velocity, a relative location, a relative velocity, a range, a predicted impact location, a predicted impact time, a closing rate, a size, a shape, and an orientation.

3. The system of claim 1, wherein the object data includes data regarding a predicted potential impact between the object and the helmet.

4. The system of claim 1, wherein the processing circuit is further configured to receive helmet data regarding the helmet, and control operation of the inflation device based on the helmet data.

5. The system of claim 4, wherein the helmet data includes an indication of at least one of a location, a velocity, an orientation, an acceleration, a size, and a shape of the helmet.

6. The system of claim 1, wherein the retraction device includes a plurality of fibers coupled to the airbag, the plurality of fibers configured to facilitate retracting the airbag.

7. The system of claim 6, wherein the processing circuit is configured to control the retraction device to selectively retract the plurality of fibers to retract the airbag.

8. The system of claim 6, wherein the retraction device includes a spring mechanism coupled to the plurality of fibers and configured to retract the fibers after inflation of the airbag.

9. The system of claim 1, wherein the retraction device includes a net, wherein at least a portion of the airbag is inflated within the net, and wherein the net is retractable to facilitate retracting the airbag.

10. The system of claim 9, wherein the processing circuit is configured to control the retraction device to selectively retract the net.

11. The system of claim 9, wherein the retraction device includes a spring mechanism coupled to the net and configured to retract the net after inflation of the airbag.

12. The system of claim 1, wherein the processing circuit is configured to deflate the airbag by controlling the ventilation device to apply a negative pressure to an interior of the airbag.

13. The system of claim 1, further comprising a sensor configured to acquire at least one of the object data and impact data.

14. The system of claim 13, wherein the sensor includes a plurality of sensors.

15. The system of claim 14, wherein the plurality of sensors form a sensor array distributed about at least a portion of a shell of the helmet.

16. A helmet airbag system, comprising:
an airbag coupled to a helmet;
an inflation device coupled to the helmet and configured to at least partially inflate the airbag;
a ventilation device configured to deflate the airbag;
a retraction device configured to retract the airbag; and
a processor configured to:
receive object data regarding an object;
predict a potential impact between the helmet and the object; and
control operation of the inflation device to inflate at least one compartment of the airbag.

17. The system of claim 16, wherein the airbag includes at least one of sloped sides, a conical shape, and a wedge shape.

18. The system of claim 16, wherein the processor is configured to control the inflation device to inflate the airbag such that the airbag is offset relative to a predicted location of the potential impact.

19. The system of claim 16, wherein the airbag includes a plurality of airbags.

20. The system of claim 19, wherein the processor is configured to differentially inflate the plurality of airbags to laterally deflect the object.

21. The system of claim 19, wherein the processor is configured to inflate one or more members of the plurality of airbags at a different time to laterally deflect the object.

22. The system of claim 16, wherein the processor is configured to control operation of the inflation device to minimize an impact parameter of the potential impact.

23. The system of claim 22, wherein the impact parameter includes at least one of a force, a torque, an impulse, and an acceleration.

24. The system of claim 16, further comprising a shape control mechanism configured to control a shape of the airbag upon inflation.

25. The system of claim 24, wherein the shape control mechanism includes a net surrounding at least a portion of the airbag.

26. The system of claim 24, wherein the shape control mechanism includes a plurality of fibers coupled to the airbag.

27. The system of claim 24, wherein the processor is configured to selectively control the shape control mechanism to control the shape of the airbag to laterally deflect the object.

28. The system of claim 16, wherein the retraction device is configured to return the airbag to a stored position.

29. A helmet, comprising:

a shell defining an interior of the helmet and an airbag system including:

an airbag at least partially disposed within the shell;

an inflation device coupled to the airbag and configured to at least partially inflate the airbag such that that the airbag deploys in a direction away from the interior of the helmet upon inflation;

a ventilation device coupled to the airbag and configured to deflate the airbag; and a processor configured to control operation of the inflation device and the ventilation device to selectively and actively inflate and deflate the airbag during a respective impact between the shell and an object external to the shell.

30. The helmet of claim 29, wherein the processor is configured to control a shape of the airbag during contact with the object.

31. The helmet of claim 29, wherein the airbag includes a plurality of airbags, at least one of the plurality of airbags including a plurality of sub-compartments coupled to the inflation device, and wherein the processor is configured to control a shape of the at least one the plurality of airbags by selectively inflating or deflating each of the plurality of sub-compartments thereof.

32. The helmet of claim 29, further comprising a shape control mechanism, wherein the processor is configured to control a shape of the airbag by controlling the shape control mechanism.

33. The helmet of claim 32, wherein the shape control mechanism includes a net surrounding at least a portion of the airbag.

34. The helmet of claim 32, wherein the shape control mechanism includes a plurality of fibers coupled to the airbag.

35. The helmet of claim 29, further comprising a sensor configured to acquire object data regarding the object, wherein the processor is configured to control operation of at least one of the inflation device and the ventilation device based on the object data.

* * * * *